US006089690A

United States Patent [19]

Hotomi

[11] Patent Number: 6,089,690

[45] Date of Patent: Jul. 18, 2000

[54] DRIVING APPARATUS FOR INKJET RECORDING APPARATUS AND METHOD FOR DRIVING INKJET HEAD

[75] Inventor: Hideo Hotomi, Nishinomiya, Japan

[73] Assignee: Minolta Co., Ltd., Osaka, Japan

[21] Appl. No.: 08/965,016

[22] Filed: Nov. 5, 1997

[30] Foreign Application Priority Data

Feb. 14, 1997 [JP] Japan ..... 9-030625

[51] Int. Cl.[7] ..... B41J 29/38

[52] U.S. Cl. ..... 347/11; 347/68

[58] Field of Search ..... 347/11, 13, 9, 347/68

[56] References Cited

U.S. PATENT DOCUMENTS

| | | | |
|---|---|---|---|
| 3,946,398 | 3/1976 | Kyser et al. | 347/70 |
| 4,369,455 | 1/1983 | McConica et al. | 347/11 |
| 4,393,388 | 7/1983 | Matsuda et al. | 347/68 |
| 4,424,520 | 1/1984 | Matsuda et al. | 347/11 |
| 4,491,851 | 1/1985 | Mizuno et al. | 347/11 |
| 4,523,200 | 6/1985 | Howkins | 347/11 |
| 4,686,539 | 8/1987 | Schmidle et al. | 347/11 |
| 5,781,203 | 7/1998 | Uriu et al. | 347/9 |
| 5,903,286 | 5/1999 | Takahashi | 347/11 |

*Primary Examiner*—N. Le
*Assistant Examiner*—Shih-wen Hsieh
*Attorney, Agent, or Firm*—Sidley & Austin

[57] ABSTRACT

In an inkjet printer, an intermediate pulse having a small amplitude is applied in the vicinity of the mid point of the driving cycle of a piezoelectric element, in other words, in the time period from the start of application of a main pulse corresponding to a single printed dot until the start of application of a main pulse corresponding to the next printed dot. The intermediate pulse having such a small amplitude can prevent a wave which results in variations in printed dots in ink in an ink channel from being generated by the main pulse. As a result, an inkjet recording apparatus capable of maintaining picture quality without increasing the load during driving the piezoelectric element can be provided.

41 Claims, 6 Drawing Sheets

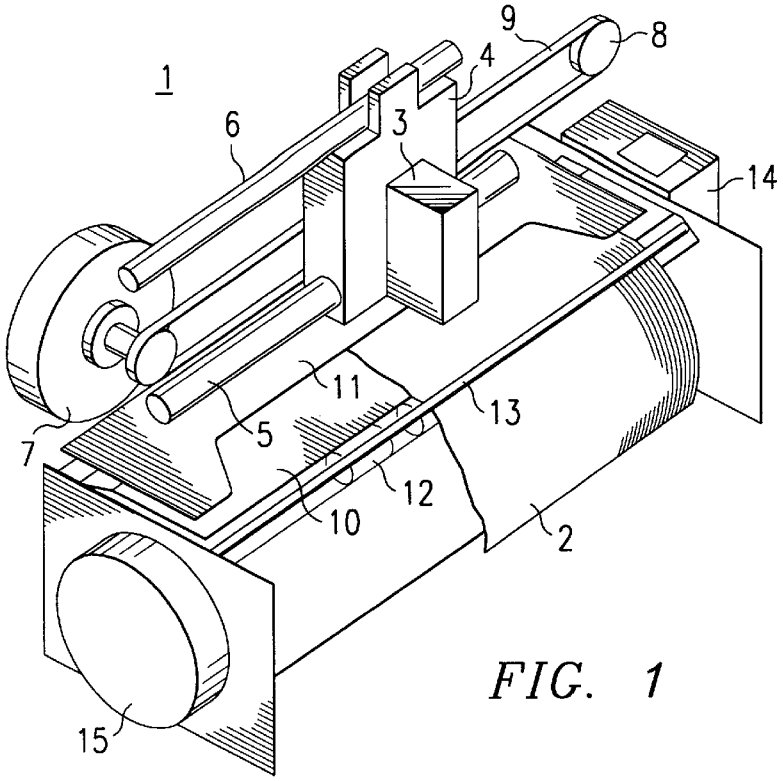
FIG. 1
FIG. 2
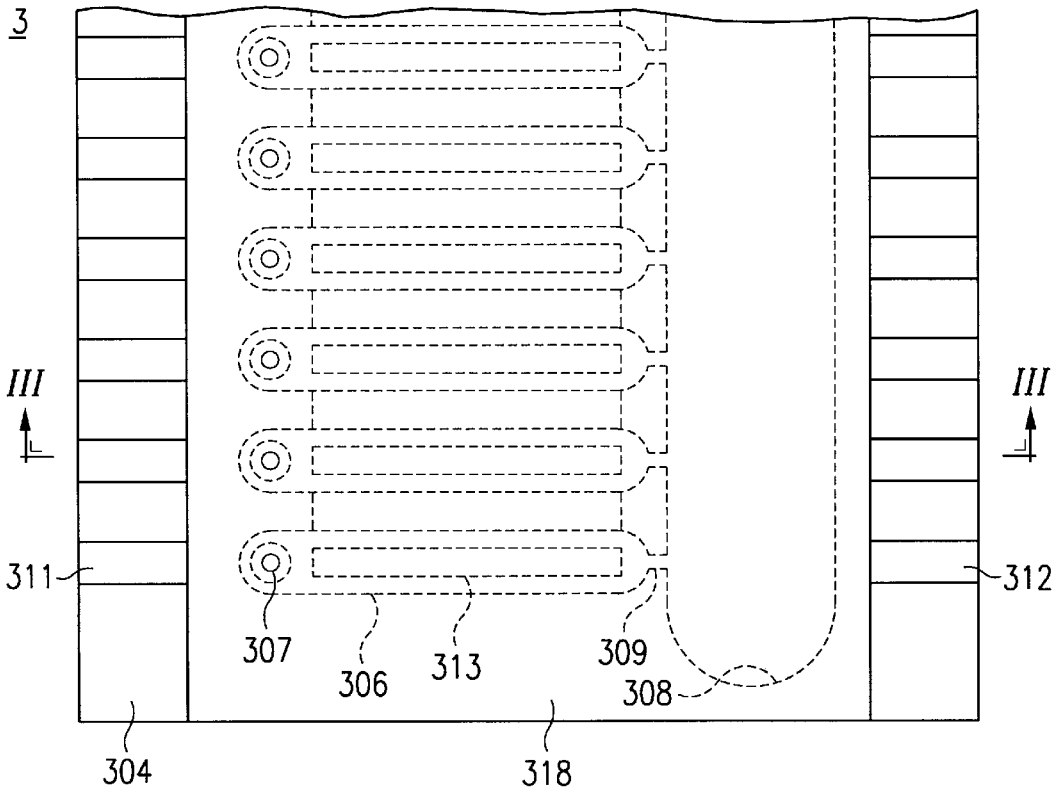

WAVEFORM A

WAVEFORM B

WAVEFORM C

DRIVING APPARATUS FOR INKJET RECORDING APPARATUS AND METHOD FOR DRIVING INKJET HEAD

BACKGROUND OF THE INVENTION

1. Field of the Invention

The present invention relates generally to inkjet recording apparatuses, and further to a driving apparatus for an inkjet recording apparatus.

2. Description of the Related Art

Among conventional printer heads for an inkjet printer, there are known a head which ejects ink by pressurizing the ink channel using a piezoelectric element, and a head which ejects ink by evaporating ink in the ink channel using a heater element. The former printer head causes distortion in the piezoelectric element by application of pulse voltage. The distortion pressurizes the ink in the ink channel, and causes a drop of the ink ejected from a nozzle in communication with the channel. By repetition of ink drop ejection, an ink image is formed on a recording sheet.

The latter printer head applies pulse voltage to the heater element provided in the ink channel to heat the same. The heat generated from the heater element partly evaporates the ink in the ink channel. Taking advantage of the expansion in volume caused by the evaporation, a drop of the ink is ejected from a nozzle. By repetition of ink drop ejection, an ink image is formed on a recording sheet.

In both printer heads, the pressure within the ink channel abruptly changes by the driving of the pulse voltage. The abrupt pressure change causes a wave in the ink channel after a drop of the ink is ejected. If the next pulse voltage is applied with the wave still remaining, the diameter (size) of each drop of the ink ejected from the nozzle is changed because of the waves, which causes variations in printed characters and results in significant degradation of the picture quality.

Although the waves are attenuated with time, if the next pulse voltage is applied after the attenuation of the waves, the printing speed is significantly lowered, contrary to the demand of high speed operation in recent years.

There is a known printer using a printer head of the former type, in other words using a piezoelectric element, which applies a sub pulse voltage immediately before applying a main pulse voltage to the piezoelectric element. In the printer, the ink in the ink channel is allowed to positively vibrate by applying the sub pulse voltage. The force created by the vibration together with the pressure created within the ink channel by the application of the main pulse voltage permit drops of the ink to be efficiently ejected from the nozzle.

Another printer of the former type, in other words a printer using a piezoelectric element, is known which applies sub pulse voltage immediately after applying a main pulse voltage to the piezoelectric element. In the printer, waves caused after a drop of ink is ejected, are prevented by applying the sub pulse voltage. More specifically, after the elapse of time almost equal to the pulse width (time) of the main pulse voltage since the main pulse voltage is stopped, the sub pulse voltage is applied.

Furthermore, there is known a printer of the latter type, in other words a printer using a heater element, which applies sub pulse voltage immediately before applying main pulse voltage. In the printer, the heater element is elevated in temperature by applying the sub pulse, so that the diameter of each drop of ink to be ejected from the nozzle is stabilized by the main pulse voltage applied after the sub pulse.

Any of the conventional ink jet printers employing the application of the sub pulse voltage does not address the adverse effect of a wave caused in the ink channel on the formation of the next drop of the ink.

SUMMARY OF THE INVENTION

It is one object of the invention to provide an ink jet printer capable of forming high quality images.

Another object of the invention is to provide an ink jet printer capable of high speed and high quality printing.

Yet another object of the invention is to apply a driving apparatus for an ink jet apparatus capable of effectively restricting the size of drops of ink from varying.

A still further object of the invention is to provide an ink jet printer capable of ejecting the next drops of ink without the influence of previously ejected drops of the ink.

An additional object of the invention is to provide an ink jet printer capable of effectively eliminating the influence of waves generated in an ink channel as the ink is ejected.

These objects of the invention are achieved by a driving apparatus for an ink jet printer including the following elements.

More specifically, one aspect of the present invention is directed to a driving apparatus used in an ink jet recording apparatus which includes a pressure applying unit for applying pressure to ink accommodated in an ink chamber. The driving apparatus applies a first pulse signal, a second pulse signal and a third pulse signal in a sequential order to said pressure applying unit. The first and third pulse signals are used for ejecting ink drops from said ink chamber respectively, and the second signal is used reducing waves in said ink chamber induced by the first pulse signal.

The second pulse signal to reduce waves in the ink chamber generated by the first pulse signal is applied between the first pulse signal and the third pulse signal. Thus, voltage having a large amplitude is not necessary to restrict the waves in the ink which are attenuated with time, and the picture quality may be maintained without increasing the load during driving the piezoelectric element.

According to another aspect of the invention, an ink jet recording apparatus for forming an ink image onto a recording medium includes an ink chamber accommodating ink therein, a nozzle connected to the ink chamber, a pressure applying unit for applying pressure to the ink in the ink chamber in response to an input pulse voltage, a driver connected to said pressure applying unit to apply a first pulse voltage, a second pulse voltage and a third pulse voltage in a sequential order to the pressure applying unit, and the first and third pulse voltages are used to eject the ink drops from the nozzle, respectively. The second voltage is used to reduce waves in the ink chamber induced by the first pulse voltage applied to the pressure applying unit.

According to yet another aspect of the invention, a method of driving an ink jet head includes the steps of (a) ejecting an ink drop from an ink chamber by applying a first pulse signal to a pressure applying unit to pressurize the ink chamber, (b) reducing waves in the ink chamber by applying a second pulse signal to the pressure applying unit to pressurize the ink chamber after the step (a), wherein the waves are induced by the application of the first pulse signal, and (c) ejecting an ink drop from the ink chamber by applying a third pulse signal to the pressure applying unit to pressurize the ink chamber after the step (b).

A still further aspect of the invention is directed to a driving apparatus used in an ink jet recording apparatus which includes a pressure applying unit for applying pressure to ink accommodated in an ink chamber. The driving apparatus applies a first pulse signal, a second pulse signal and a third pulse signal in a sequential order to the pressure applying unit, the first and third pulse signals are used for ejecting ink drops from the nozzle respectively, and the second signal is not used for ejecting ink drops from the nozzle, wherein the timing of application of the first, second and third pulse signals satisfies the following formulas;

$$T0>T3\geqq T2>T1 \quad (1)$$

$$T2\geqq 2\times T1 \quad (2)$$

$$T3\geqq 3\times T1 \quad (3)$$

wherein T0 is the time period from the start of application of the first pulse signal to the start of application of the third pulse signal, T1 is the pulse width (time) of said first pulse signal, T2 is the time period from the end of application of the first pulse signal to the start of application of the second pulse signal, and T3 is the time period from the end of application of the second pulse signal to the start of application of the third pulse signal.

According to an additional aspect of the present invention, an inkjet head includes a pressure applying unit for applying pressure to ink accommodated in an ink chamber in accordance with a pulse signal applied by a driving apparatus. The driving apparatus includes a pulse signal generating circuit electrically connected with the pressure applying unit to generate a main pulse signal and an intermediate pulse signal based on an input image signal. The main pulse signal and the intermediate pulse signal are applied to the pressure applying unit in a sequential order, wherein the main pulse signal is to eject an ink drop from the ink chamber and the intermediate signal is to reduce waves in the ink chamber induced by the main pulse signal applied by the pressure applying unit.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 1 is a perspective view schematically showing the structure of an inkjet printer according to a first embodiment of the invention;

FIG. 2 is a plan view for use in illustration of the structure of the printer head;

DESCRIPTION OF THE PREFERRED EMBODIMENTS

Figure 3:
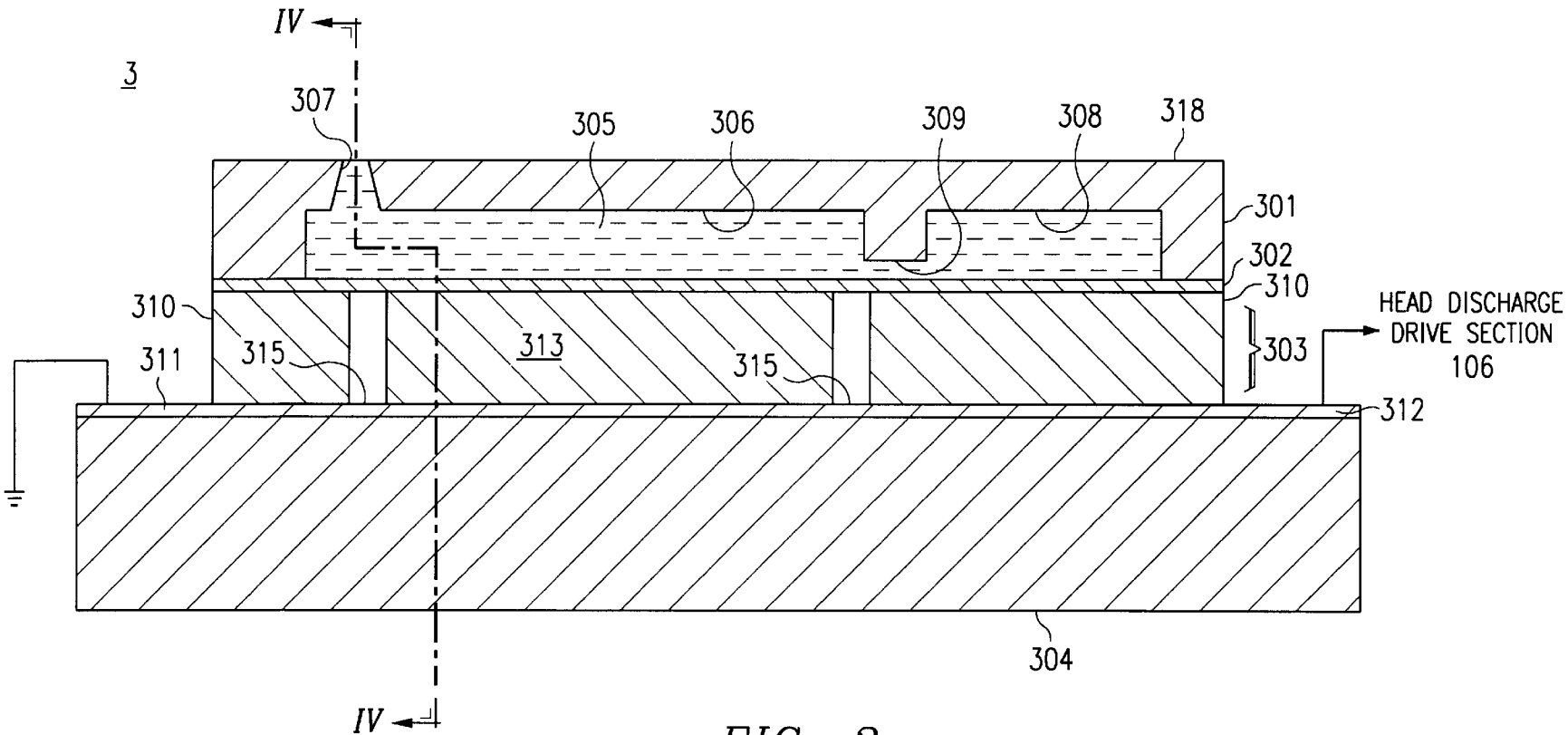
FIG. 3 is a cross sectional view for use in illustration of the structure of the printer head.

An inkjet printer according to one embodiment of the invention will be now described in conjunction with the accompanying drawings.

Referring to FIG. 1, inkjet printer 1 includes a printer head 3 of an inkjet type, a carriage 4 for carrying printer head 3, swinging shafts 5 and 6 for reciprocating carriage 4 in parallel to the recording surface of a recording sheet 2, i.e., a recording medium such as paper and OHP sheet, a driving motor 7 for driving carriage 4 to reciprocate along swinging shaft shafts 5 and 6, a timing belt 9 for converting the revolution of driving motor 7 into the reciprocating movement of the carriage, and an idle pulley 8.

Inkjet printer 1 further includes a platen 10 also serving as a guide plate to guide recording sheet 2 along a transport path, a sheet pressing plate 11 for preventing recording sheet 2 on platen 10 from rising, a discharge roller 12 to discharge recording sheet 2, a spur roller 13, a recovering system 14 for cleaning the nozzle surface to eject ink in printer head 3, thereby returning an ink ejecting fault to a normal state, and a paper feeding knob is for manually transporting recording sheet 2.

Recording sheet 2 is fed manually or by the function of a paper feeding device such as a cut sheet feeder into the recording unit in which printer head 3 and platen 10 oppose each other. During this time, the amount of revolution of the paper feeding roller, which is not shown in FIG. 1 is adjusted so as to control the transportation of the recording sheet 2 into the recording unit.

A piezoelectric element (PZT) is used for printer head 3 as an energy generator for ink ejection. The piezoelectric element is supplied with voltage and distorted. The distortion changes the volume of the channel filled with the ink. The change in the volume causes the ink to be ejected from the nozzle provided at the channel, and data is recorded onto recording sheet 2.

Carriage 4 scans recording sheet 2 in a main scanning direction (in the direction of transversely crossing recording sheet 2) by the function of driving motor 7, idle pulley 8, and timing belt 9, and printer head 3 attached at carriage 4 records images for one line. Every time the recording of one line completes, recording sheet 2 is sent in a sub scanning direction (the lengthwise direction) and then the next line is recorded.

Images are thus recorded onto recording sheet 2, which, after passed through the recording unit, is discharged by discharge roller 12 disposed on the downstream side in the transporting direction and spur roller 13 in abutment under pressure against roller 12 under pressure.

Figure 4:
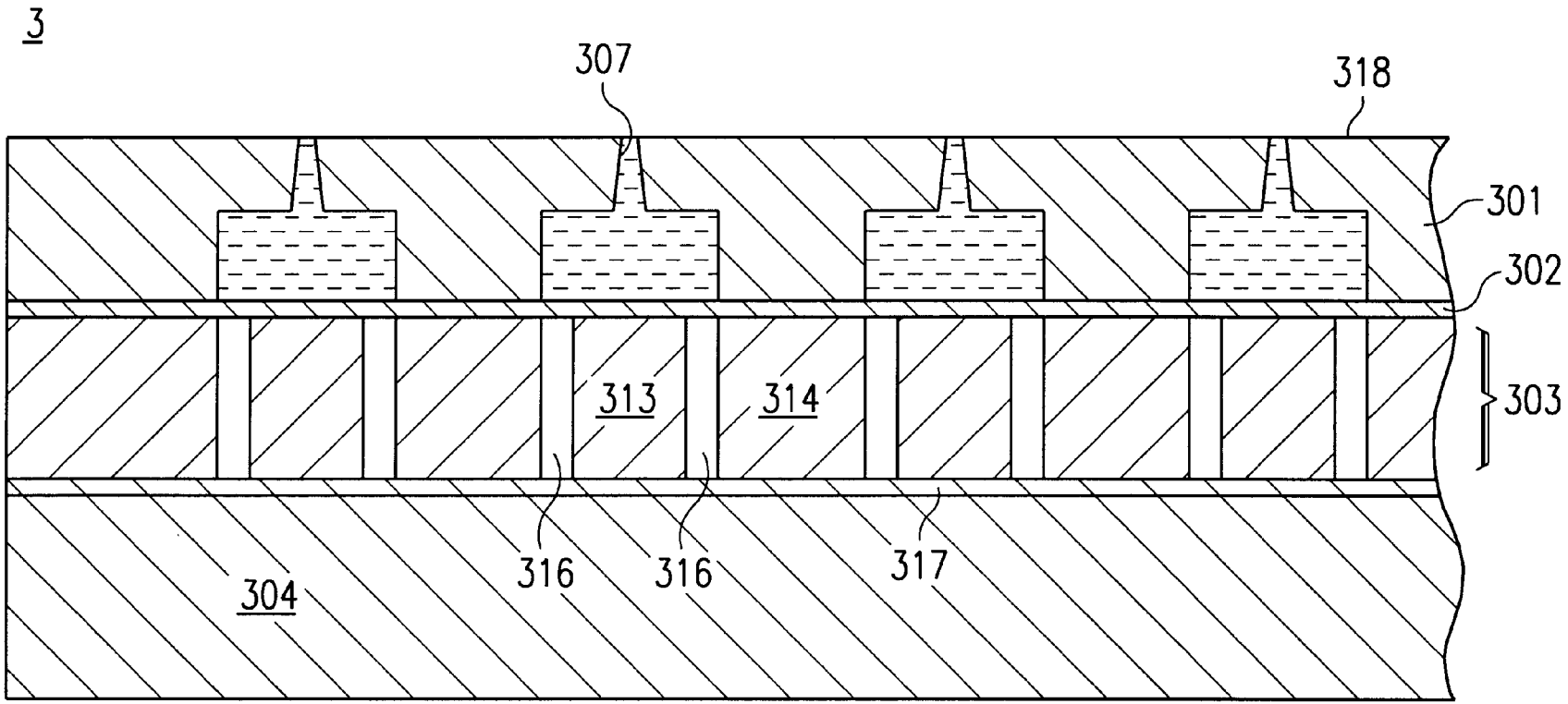
FIG. 4 is a cross sectional view for use in illustration of the structure of the printer head.

FIGS. 2 to 4 are views for use in illustration of the structure of printer head 3.

FIG. 2 is a plan view showing printer head 3, FIG. 3 a cross sectional view taken along line III—III in FIG. 2, and FIG. 4 a cross sectional view taken along line IV—IV in FIG. 3.

Printer head 3 is formed of a nozzle plate 301, a partitioning plate 302, a vibrating plate 303 and a substrate 304 which are integrally placed upon each other.

Nozzle plate 301 is formed of a metal or ceramics has nozzles 307, and an ion generating layer on its surface 318. Partitioning wall 302 of a thin film is fixed between nozzle plate 301 and vibrating plate 303.

Note that the direction in which nozzles 307 are arranged corresponds to the vertical scanning direction as described above, and printer head 3 is moved by carriage 4 in the horizontal scanning direction (the direction from the top to bottom in FIG. 2) perpendicular to the vertical scanning direction.

There are provided between nozzle plate 301 and partitioning plate 302, a plurality of ink channels 306 to accommodate ink 305, and an ink inlet 309 to couple each ink channel 306 to an ink supply chamber 308. Ink supply chamber 308 is connected to an ink tank which is not shown, and ink 305 in ink supply chamber 308 is supplied to ink channels 306.

Vibrating plate 303 includes a plurality of piezoelectric elements 313 corresponding to ink channels 306. Vibrating plate 303 is fixed to substrate 304 having an interconnection portion 317 with an insulation adhesive, and then separate grooves 315 and 316 are formed by dicer processing to segment vibrating plate 303. The segmentation also separates a piezoelectric element pillar portion 314 positioned between piezoelectric element 313 corresponding to ink channel 306 and an adjacent piezoelectric element 313 and a surrounding wall 310 from each other.

Interconnection portion 317 on substrate 304 has a common electrode side interconnection portion 311 connected to ground and commonly connected to all the piezoelectric elements 313 in printer head 3 and an individual electrode side interconnection portion 312 individually connected to each piezoelectric element 313 in printer head 3. Common electrode side interconnection portion 311 on substrate 304 is connected to a common electrode in piezoelectric element 313, while individual electrode side interconnection portion 312 is connected to an individual electrode in piezoelectric element 313.

The operation of such printer head 3 is controlled by the control unit of ink jet printer 1. The head driver 56 of the control unit (see FIGS. 5A and 5B) supplies a printing signal, i.e., prescribed voltage between the common electrode and the individual electrode provided in piezoelectric element 313, which deforms the element in the direction of pressing partitioning wall 302. The deformation of piezoelectric element 313 is transmitted to partitioning wall 302, which pressurizes ink 305 in ink channel 306, and an ink drop is ejected toward recording sheet 2 (see FIG. 1) through nozzle 307.

Figure 5A:
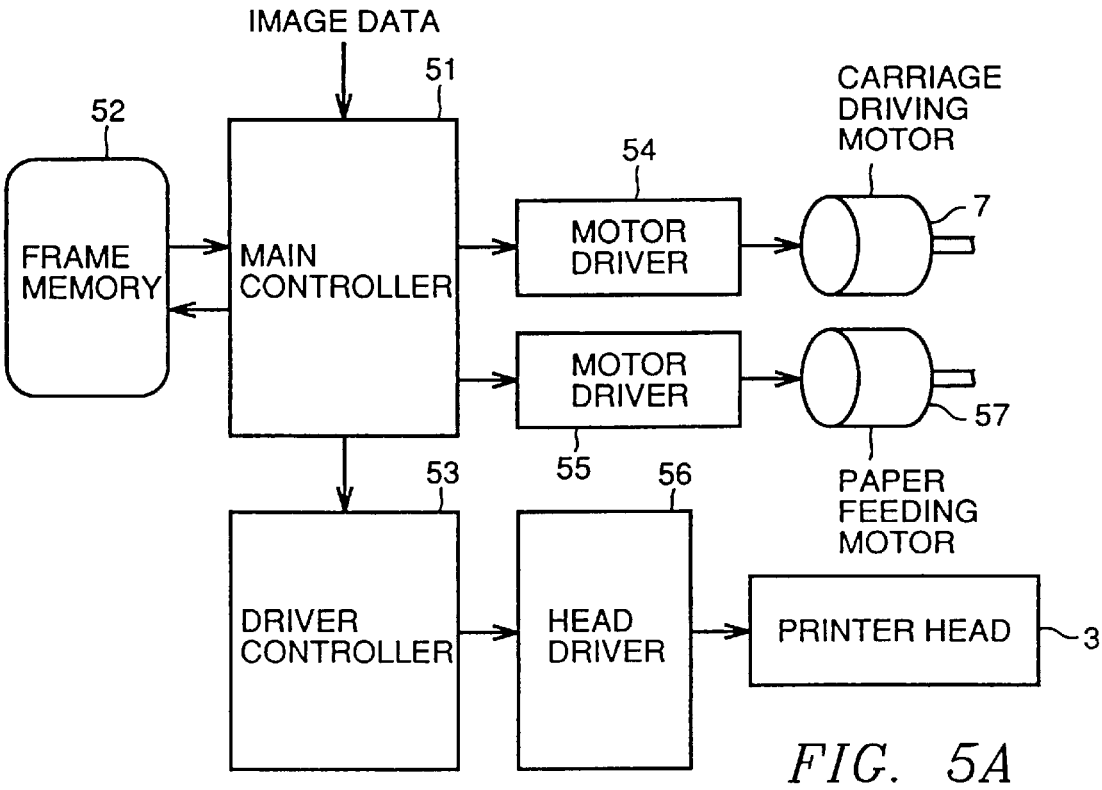
FIGS. 5A and 5B are block diagrams showing the configurations of a control unit and a head driver in an ink jet printer.
Figure 5B:
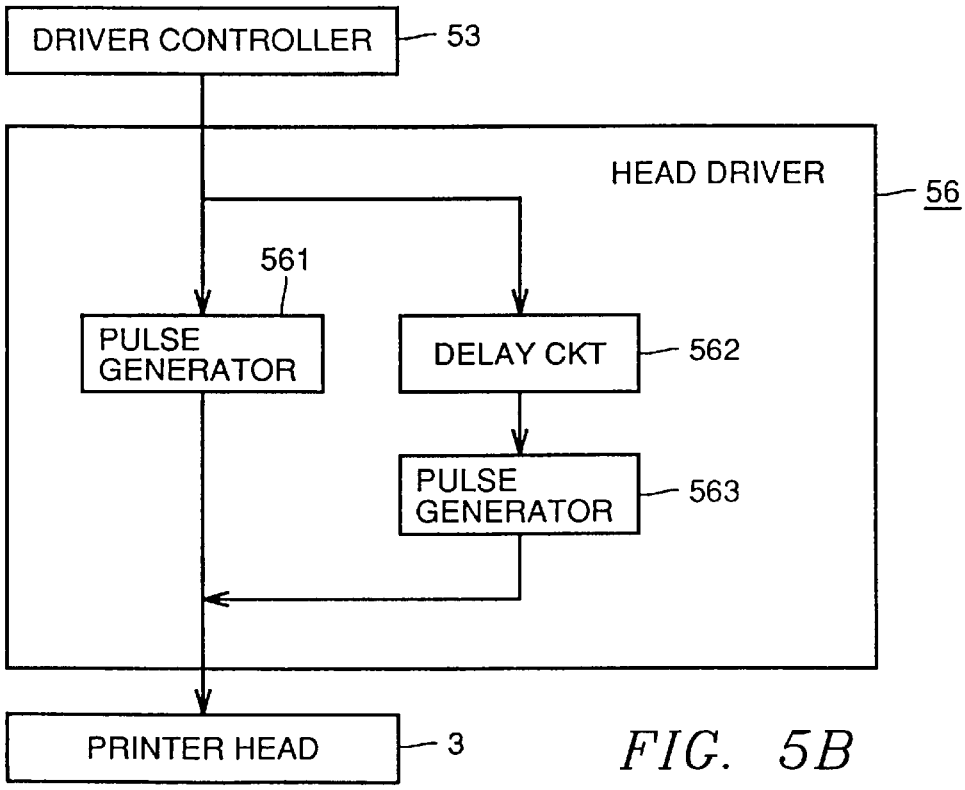

FIG. 5A is a block diagram showing the configuration of the control unit of ink jet printer 1, while FIG. 5B is a block diagram showing the configuration of head driver 56 in FIG. 5A.

As shown in FIG. 5A, the control unit mainly includes a main controller 51 formed of for example a one-chip microcomputer. Main controller 51 is connected to a frame memory 52, a driver controller 53 and motor drivers 54 and 55. Driver controller 53 is connected with printer head 3 through head driver 56. Meanwhile, motor drivers 54 and 55 are connected with driving motor 7 for moving the carriage and the driving motor 57 for paper feeding, respectively.

Main controller 51 receives image data input from a computer or the like and stores the image data be stored on a 1-frame basis into frame memory 52 for buffer. At the time of printing onto recording sheet 2, main controller 51 controls driving motor 7 for moving the carriage and the driving motor for paper feeding through motor drivers 54 and 55. Main controller 51 controls the driving of the motors as described above and also reads out image data from frame memory 52 for supply to driver controller 53.

Driver controller 53 also has its operation timing controlled by main controller 51, and outputs a pulse signal to head driver 56 based on image data, in synchronization with the movement of recording sheet 2 and carriage 4.

Head driver 56 changes the pulse signal supplied from driver controller 53 into a signal to be actually supplied to printer head 3. More specifically, as shown in FIG. 5B, head driver 56 includes a pulse generator 561, a delay circuit 562, and a pulse generator 563, and the pulse signal from driver controller 53 is supplied to pulse generator 561 and delay circuit 562. Pulse generator 561 changes the waveform of the input pulse signal into a signal waveform to be actually supplied to piezoelectric element 313 in printer head 3. Delay circuit 562 delays the input pulse signal for a prescribed time period for supply to pulse generator 563. Pulse generator 563 changes the waveform of thus delayed and supplied pulse signal into a signal waveform to be actually supplied to piezoelectric element 313 in printer head 3.

In the configuration of the control unit, two driving pulse signals are supplied to printer head 3 based on single image data. They are the pulse signal (main pulse) generated by pulse generator 561, and the pulse signal (intermediate pulse) generated by delay circuit 562 and pulse generator 563.

Note that the delay time period of the pulse signal in delay circuit 562 as described above may be fixed or set using main controller 51.

Main Controller 51 also controls the driving of each piezoelectric element 313 in printer head 3 through driver controller 53 and head driver 56 based on image data read out from frame memory 52.

Figure 6A:
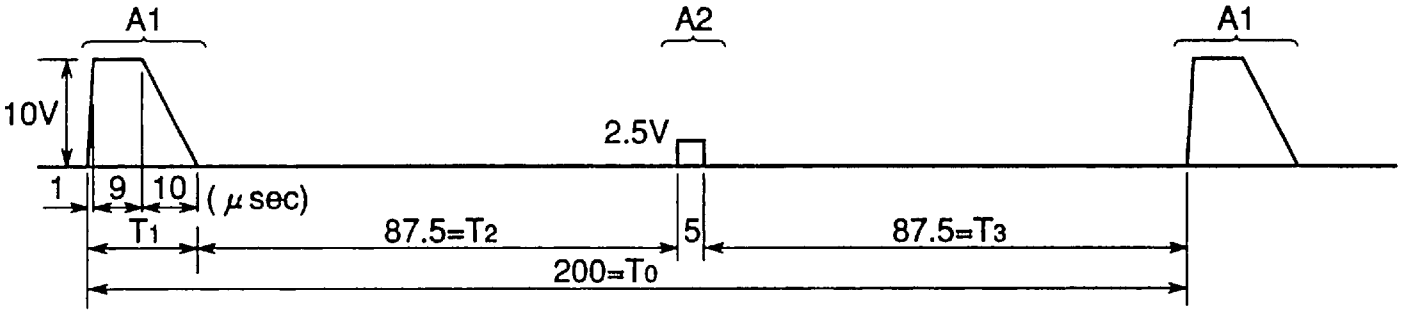
FIGS. 6A to 6C are waveform charts for use in illustration of the waveforms of pulse voltages to drive a piezoelectric element in the ink jet printer according to embodiments of the invention.
Figure 6B:
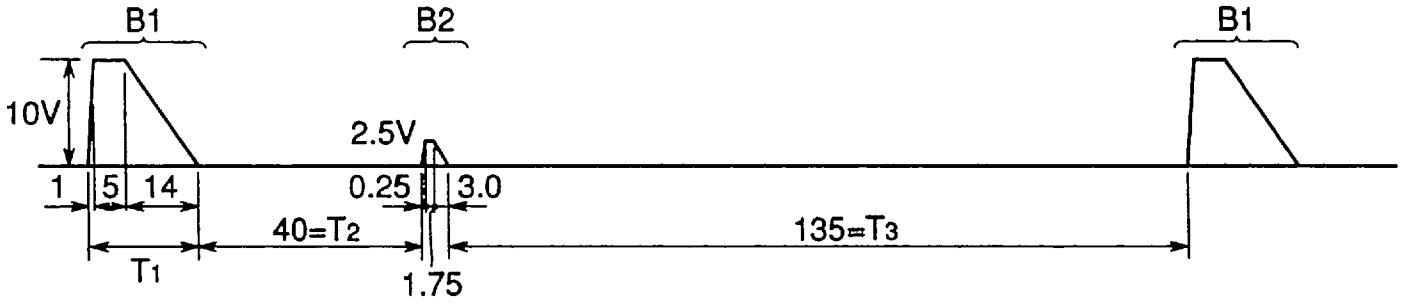
Figure 6C:
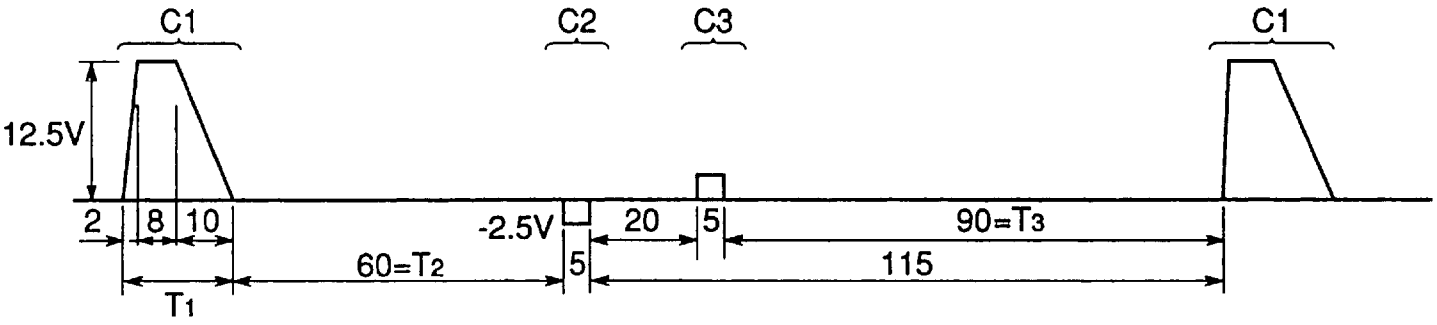

FIGS. 6A–6C are waveform charts for use in illustration of pulse voltage waveforms A to C to drive the piezoelectric element in the ink jet printer according to the embodiment of the invention. FIG. 6A is a waveform chart showing pulse voltage waveform A to drive piezoelectric element 313 in the printer head 3 of ink jet printer 1, FIG. 6B pulse voltage waveform B to drive a piezoelectric element in a printer head in an ink jet printer according to a second embodiment, and FIG. 6C pulse voltage waveform C to drive a piezoelectric element in a printer head 3 in an inkjet printer according to a third embodiment.

Note that a plurality of piezoelectric elements 313 are actually provided to printer head 3 in the vertical scanning direction, and these piezoelectric element 313 are individually provided with pulse voltage in various waveforms.

The configurations of the inkjet printers, printer heads and control unit according to the second and third embodiments are the same as those of the inkjet printer according to the first embodiment, and these pulse voltages are provided to piezoelectric elements in the printer head by the head driver as described above.

Waveform A includes a main pulse A1 applied to a piezoelectric element corresponding to a single ink drop, and an intermediate pulse A2 applied to the piezoelectric element between main pulse A1 and the next main pulse A1.

Main pulse A1 is raised from 0 V to 10 V in amplitude for a rising period of 1 $\mu$sec followed by the continuation of the amplitude for 9 $\mu$sec, and then made to fall from 10 V to 0 V in a falling time period of 10 $\mu$sec. The pulse width T1 of main pulse A1 is 20 $\mu$sec. Intermediate pulse A2 is raised form 0 V to 2.5 V in amplitude followed by the continuation of the amplitude for 5 $\mu$sec, and then made to fall from 2.5 V to 0 V. FIG. 6A illustrates that the amplitude of main pulse A1 is substantially greater than the amplitude of intermediate pulse A2.

The driving cycle between main pulse A1 and the next main pulse A1 is 200 $\mu$sec (i.e., the driving frequency is 5 kHz), and time period T2 since the falling of main pulse A1 until the rising of intermediate pulse A2 and time T3 since the falling of intermediate pulse A2 until the rising of the next main pulse A1 are both 87.5 $\mu$sec.

Waveform B includes a main pulse B1 applied to the piezoelectric element corresponding to a single ink drop, and an intermediate pulse B2 applied to the piezoelectric element between main pulse B1 and the next main pulse B1.

Main pulse B1 is raised from 0 V to 10 V in amplitude in a rising time period of 1 μsec, followed by the continuation of the amplitude for 5 μsec, and then made to fall from 10 V to 0 V in a falling time period of 14 μsec. The pulse width T1 of main pulse B1 is 20 μsec. Intermediate pulse B2 is raised from 0 V to 2.5 V in amplitude in a rising time period of 0.25 μsec, followed by the continuation of the amplitude for 1.75 μsec, and then made to fall from 2.5 V to 0 V in a falling time period of 3 μsec. FIG. 6B illustrates that the amplitude of main pulse B1 is substantially greater than the amplitude of intermediate pulse B2.

The driving cycle, in other words the time between main pulse B1 and the next main pulse B1 is 200 μsec (in other words the driving frequency is 5 kHz), and time period T2 since the falling of main pulse B1 until the rising of intermediate pulse B2 is 40 μsec, and time period T3 since the falling of intermediate pulse B2 until the rising of the next main pulse B1 is 135 μsec.

Waveform C includes a main pulse C1 applied to the piezoelectric element corresponding to a single ink drop, and intermediate pulses C2 and C3 applied to the piezoelectric element between main pulse C1 and the next main pulse C1.

Main pulse C1 is raised from 0 V to 12.5 V in a rising time period of 2 μsec, followed by the continuation of the amplitude for 8 μsec, and then made to fall from 12.5 V to 0 V in a falling time period of 10 μsec. The pulse width T1 of main pulse C1 is 20 μsec. Intermediate pulse C2 is raised from 0 V to −2.5 V in amplitude, followed by the continuation of the amplitude for 5 μsec, and then made to fall from −2.5 V to 0 V. Intermediate pulse C3 is raised from 0 V to 2.5 V in amplitude, followed by the continuation of the amplitude for 5 μsec, and then made to fall from 2.5 V to 0 V. FIG. 6C illustrates that the amplitude of main pulse C1 is substantially greater than the absolute value of the amplitudes of intermediate pulses C2 and C3.

The driving cycle, in other words the time period between main pulse C1 and the next main pulse C1, is 200 μsec (in other words the driving frequency is 5 kHz), the time period T2 since the falling of main pulse C1 until the rising of intermediate pulse C2 is 60 μsec, the time period since the falling of intermediate pulse C2 until the rising of intermediate pulse C3 is 20 μsec, and time period T3 since the falling of intermediate pulse C3 until the rising of main pulse C1 is 90 μsec.

The timings for applying the intermediate pulses in waveforms A to C satisfy the following conditions (1) to (3):

$$T0>T3\geqq T2>T1 \quad (1)$$

$$T2\geqq 2\times T1 \quad (2)$$

$$T3\geqq 3\times T1 \quad (3)$$

wherein T0 is the time period since the start of application of the first main pulse voltage until the start of application of the second main pulse voltage, T1 is the pulse width (application time) of the first main pulse voltage, T2 is the time period since the end of application of the first main pulse voltage until the start of application of the intermediate voltage (group), and T3 is the time period since the end of application of the intermediate pulse voltage (group) until the start of application of the second main pulse voltage.

Now, the effects of waveforms A to C to drive the piezoelectric element described in conjunction with FIGS. 6A to 6C will be described.

Figure 7:
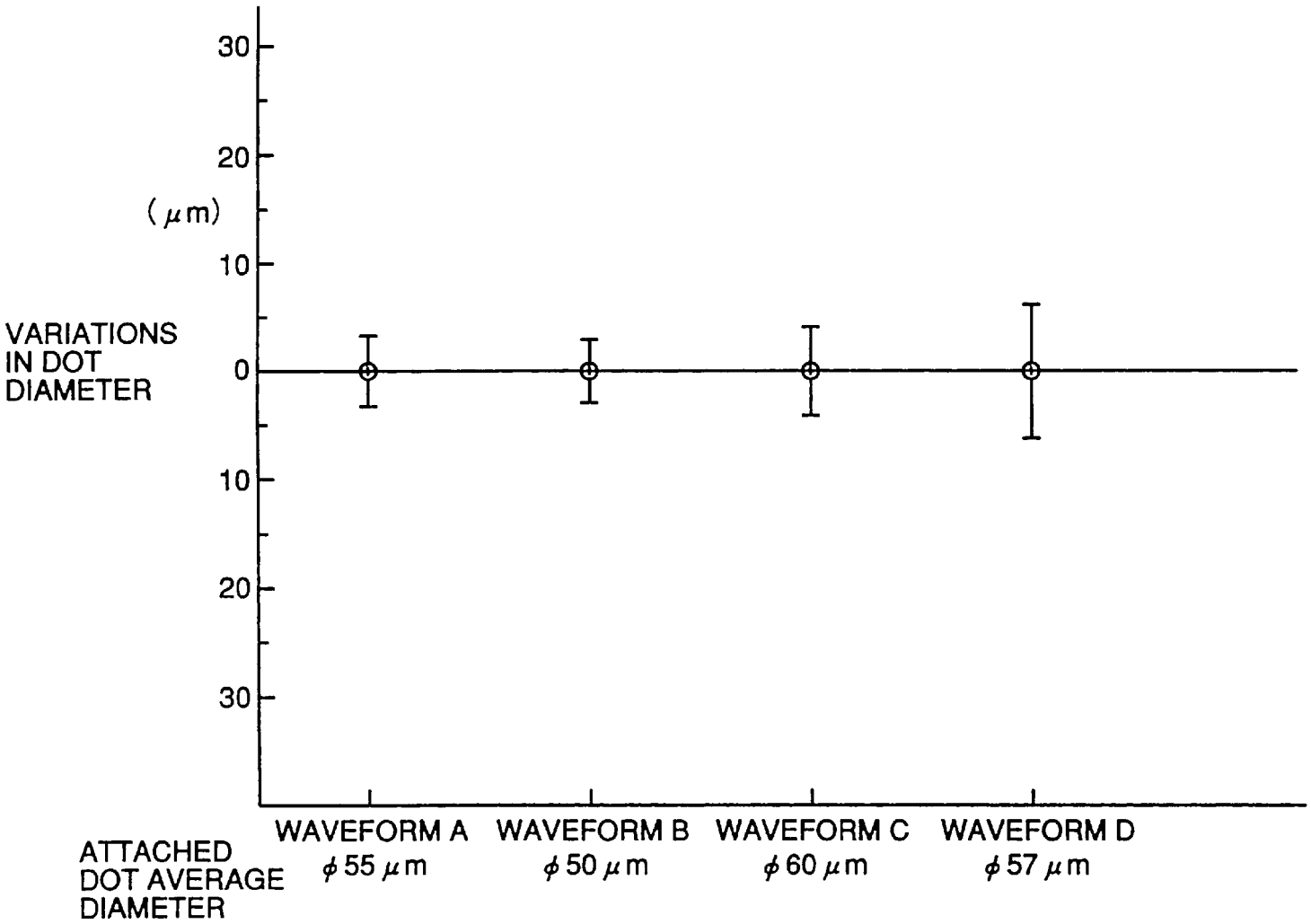
FIG. 7 is a graph for use in illustration of variations in size of printed dots based on the waveforms A to D of the pulse voltages.

FIG. 7 is a graph for use in illustration of variations in the printed dot size using pulse voltage waveforms A to C in comparison with a conventional pulse voltage waveform D. Waveform D does not include the intermediate pulse of waveform A shown in FIG. 5A, and variations in the dot size printed by applying the pulse voltage of waveform D to the piezoelectric element is similarly given in FIG. 7.

These variations in printed characters were produced by measuring the size of 200 printed dots at a driving frequency of 5 kHz, only by changing the pulse voltage applied to the piezoelectric element while the other conditions such as printing sheet are the same. In FIG. 7, the mean value of the printed dot size is positioned in the center, and the width from the maximum value to the minimum value of the dot is given as differentials from the mean value of the dot size.

For waveform A, the average printed dot size was 55 μm, and the maximum and minimum differentials from the average value were both 3 μm. For waveform B, the average printed dot size was 50 μm, and the maximum and minimum differentials from the average value were both 3 μm. For waveform C, the average printed dot size was 60 μm, and the maximum and minimum differentials from the average value were both 4 μm. In comparison, for waveform D given as a comparison example, the average printed dot size was 57 μm, and the maximum and minimum differentials from the average value were both 7 μm.

During evaluating these variations in the printed dot size, a variation of ±5 μm or greater usually would not cause any problem in the case of binary printing, but the variation of ±5 μm or greater could lead to gray level inversion during expressing the gray level by dots of various sizes. Therefore, when the dot size is controlled for gray level printing, the present invention provides significant advantage since each dot size is properly controlled.

A specific approach of controlling the dot size may be to change the waveform of a main pulse based on gray level data. In order to change the waveform, the voltage value of the main pulse may be changed or the pulse width of the main pulse may be changed. Furthermore, a sub pulse may be applied in addition to the main pulse for the purpose of controlling the dot size. Such a sub pulse may be applied immediately before or immediately after the application of the main pulse. In such a case, the main pulse, sub pulse and intermediate pulse as described above are applied to piezoelectric element 313.

In considering the advantage together with the results of measurement as described above, by applying an intermediate pulse which has an amplitude as small as 2 V to 3 V and does not independently cause an ink drop to be ejected only by itself, in the vicinity of the mid point of the cycle of the main pulse which drives the piezoelectric element and corresponds to a single printing dot such as waveforms A to C, the variations in printed dot size like that by waveform D may be restricted.

In particular, if conditions (1) to (3) are satisfied as for the timing to apply intermediate pulses, variations in the printed dot size may be more effectively restricted. However, as long as the wave generated in the ink in the ink channel may be prevented or reduced, the timing to apply the intermediate pulse is not limited to those which satisfy conditions (1) to (3).

In the above embodiments, the waveform of the main pulse was trapezoid, or the waveform of the intermediate pulse voltage was trapezoid or square for the purpose of illustration, the present invention is not limited to these waveforms, and the main pulse voltage or intermediate pulse voltage may have a triangular waveform.

Also in the above embodiments, the printer head using the piezoelectric element was described as the structure for pressurizing the ink in the ink channel, the present invention is not limited to the structure, and a conventional heater element may be used.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A driving apparatus adapted for use with an inkjet printer, said inkjet printer including a pressure applying device adapted for applying pressure to ink, accommodated in an ink chamber, in accordance with a pulse signal applied by said driving apparatus, said driving apparatus adapted for applying a first pulse signal, a second pulse signal and a third pulse signal to said pressure applying device in sequence as recited, wherein each of said first pulse signal and said third pulse signal is adapted for ejecting an ink drop from said ink chamber, wherein said second pulse signal is adapted for reducing a reflected wave in said ink chamber induced by said pressure applying device applying said first pulse signal, and wherein timing of application of said first pulse signal, said second pulse signal and said third pulse signal satisfies the following formulas:

$$T0>T3\geqq T2>T1,$$

$$T2\geqq 2\times T1, \text{ and}$$

$$T3\geqq 3\times T1$$

wherein

T0 is a time period measured from a start of application of said first pulse signal to a start of application of said third pulse signal, T1 is a pulse width of said first pulse signal, T2 is a time period measured from an end of application of said first pulse signal to a start of application of said second pulse signal, and T3 is a time period measured from an end of application of said second pulse signal to the start of application of said third pulse signal.

2. A driving apparatus as claimed in claim 1, wherein said second pulse signal is different from each of said first pulse signal and said third pulse signal in form.

3. A driving apparatus as claimed in claim 2, wherein said second pulse signal is smaller than each of said first pulse signal and said third pulse signal in pulse width.

4. A driving apparatus as claimed in claim 2, wherein said second pulse signal is smaller than each of said first pulse signal and said third pulse signal in amplitude.

5. A driving apparatus as claimed in claim 1, wherein said first pulse signal and said second pulse signal are generated in accordance with an input image signal.

6. An inkjet recording apparatus for forming an ink image on a recording medium, said inkjet recording apparatus comprising:

an ink chamber for accommodating ink therein;

a nozzle connected to said ink chamber;

a pressure applying device for applying pressure to an ink in said ink chamber in response to an input pulse voltage; and a driver which is connected to said pressure applying device, wherein said driver is adapted for applying a first pulse signal, a second pulse signal and a third pulse signal to said pressure applying device in sequence as recited, wherein each of said first pulse signal and said third pulse signal is adapted for ejecting an ink drop from said nozzle, wherein said second pulse signal is adapted for reducing a reflected wave in said ink chamber induced by said pressure applying device applying said first pulse signal, and wherein timing of application of said first pulse signal, said second pulse signal and said third pulse signal satisfies the following formulas:

$$T0>T3\geqq T2>T1,$$

$$T2\geqq 2\times T1, \text{ and}$$

$$T3\geqq 3\times T1$$

wherein

T0 is a time period measured from a start of application of said first pulse signal to a start of application of said third pulse signal, T1 is a pulse width of said first pulse signal, T2 is a time period measured from an end of application of said first pulse signal to a start of application of said second pulse signal, and T3 is a time period measured from an end of application of said second pulse signal to the start of application of said third pulse signal.

7. An inkjet recording apparatus as claimed in claim 6, wherein said second pulse signal is different from each of said first pulse signal and said third pulse signal in form.

8. An inkjet recording apparatus as claimed in claim 7, wherein said second pulse signal is smaller than each of said first pulse signal and said third pulse signal in pulse width.

9. An inkjet recording apparatus as claimed in claim 7, wherein said second pulse signal is smaller than each of said first pulse signal and said third pulse signal in amplitude.

10. An inkjet recording apparatus as claimed in claim 6, wherein said first pulse signal and said second pulse signal are generated in accordance with an input image signal.

11. An inkjet recording apparatus as claimed in claim 6, wherein said pressure applying device comprises a piezoelectric member.

12. A method for driving an inkjet head, comprising the steps of:

(a) ejecting an ink drop from an ink chamber by applying a first pulse signal to a pressure applying device so as to pressurize said ink chamber;

(b) reducing a reflected wave in said ink chamber by applying a second pulse signal to said pressure applying device so as to pressurize said ink chamber after step (a), wherein said reflected wave is induced by the application of said first pulse signal; and (c) ejecting an ink drop from said ink chamber by applying a third pulse signal to said pressure applying device so as to pressurize said ink chamber after step (b), wherein timing of application of said first pulse signal, said second pulse signal and said third pulse signal satisfies the following formulas:

$T0>T3\geqq T2>T1$, $T2\geqq 2\times T1$, and $T3\geqq 3\times T1$ wherein

T0 is a time period measured from a start of application of said first pulse signal to a start of application of said third pulse signal, T1 is a pulse width of said first pulse signal, T2 is a time period measured from an end of application of said first pulse signal to a start of application of said second pulse signal, and T3 is a time period measured from an end of application of said second pulse signal to the start of application of said third pulse signal.

13. A method as claimed in claim 12, wherein said second pulse signal is different from each of said first pulse signal and said third pulse signal in form.

14. A method as claimed in claim 13, wherein said second pulse signal is different from each of said first pulse signal and said third pulse signal in pulse width.

15. A method as claimed in claim 13, wherein said second pulse signal is different from each of said first pulse signal and said third pulse signal in amplitude.

16. An inkjet recording apparatus comprising:

an ink chamber;

a driving apparatus; and a pressure applying device adapted for applying pressure to ink accommodated in said ink chamber in accordance with a pulse signal applied by said driving apparatus, said driving apparatus adapted for applying a first pulse signal, a second pulse signal and a third pulse signal to said pressure applying device in sequence as recited, wherein each of said first pulse signal and said third pulse signal is adapted for ejecting an ink drop from a nozzle attached to said ink chamber, wherein said second pulse signal is adapted for avoiding ejecting an ink drop from said nozzle, wherein timing of application of said first pulse signal, said second pulse signal, and said third pulse signal satisfies the following formulas:

$T0>T3\geqq T2>T1$ $T2\geqq 2\times T1$ $T3\geqq 3\times T1$ wherein

T0 is a time period measured from a start of application of said first pulse signal to a start of application of said third pulse signal, T1 is a pulse width of said first pulse signal, T2 is a time period measured from an end of application of said first pulse signal to a start of application of said second pulse signal, and T3 is a time period measured from an end of application of said second pulse signal to the start of application of said third pulse signal.

17. A driving apparatus adapted for use with an inkjet printer, said inkjet printer including a pressure applying device adapted for applying pressure to ink accommodated in an ink chamber, in accordance with a pulse signal applied by said driving apparatus, said driving apparatus comprising:

a pulse signal generating circuit electrically connected with said pressure applying device, said pulse signal generating circuit adapted for generating a main pulse signal and an intermediate pulse signal based on an input image signal, wherein said main pulse signal is adapted for ejecting an ink drop from said ink chamber, and wherein said intermediate pulse signal is adapted for reducing a reflected wave in said ink chamber induced by said pressure applying device applying the main pulse signal, wherein said pulse signal generating circuit is adapted for applying a first main pulse signal, a second intermediate pulse signal and a third main pulse signal to said pressure applying device in sequence as recited, wherein timing of application of said first main pulse signal, said second intermediate pulse signal and said third main pulse signal satisfies the following formulas:

$T0>T3\geqq T2>T1$, $T2\geqq 2\times T1$, and $T3\geqq 3\times T1$ wherein

T0 is a time period measured from a start of application of said first main pulse signal to a start of application of said third main pulse signal, T1 is a pulse width of said first main pulse signal, T2 is a time period measured from an end of application of said first main pulse signal to a start of application of said second intermediate pulse signal, and T3 is a time period measured from an end of application of said second intermediate pulse signal to the start of application of said third main pulse signal.

18. A driving apparatus as claimed in claim 17, wherein said pulse signal generating circuit comprises:

a first pulse generating circuit adapted for generating said main pulse signal based on said input image signal;

a delay circuit adapted for receiving said input image signal and for providing a time delayed input image signal; and a second pulse generating circuit for generating said intermediate pulse signal based on said time delayed input image signal.

19. A driving apparatus as claimed in claim 17 wherein said main pulse signal is different from said intermediate pulse signal in form.

20. A driving apparatus as claimed in claim 19, wherein said main pulse signal is different from said intermediate pulse signal in amplitude.

21. A driving apparatus as claimed in claim 17, wherein said main pulse signal is different from said intermediate pulse signal in pulse width.

22. An inkjet recording apparatus comprising:

an ink chamber;

a driving apparatus; and a pressure applying device adapted for applying pressure to ink, accommodated in said ink chamber, in accordance with a pulse signal applied by said driving apparatus, said driving apparatus being adapted for applying to said pressure applying device:

a first pulse signal having a first amplitude;

a second pulse signal having a second amplitude; and a third pulse signal; in sequence as recited, wherein said first amplitude is substantially greater than said second amplitude, wherein each of said first pulse signal and said third pulse signal is adapted for ejecting an ink drop from said ink chamber, wherein said second pulse signal is adapted for reducing a reflected wave in said ink chamber induced by said pressure applying device applying said first pulse signal, and wherein timing of application of said first pulse signal, said second pulse signal and said third pulse signal satisfies the following formulas:

$$T0>T3\geqq T2>T1$$

$$T2\geqq 2\times T1$$

$$T3\geqq 3\times T1$$

wherein

T0 is a time period measured from a start of application of said first pulse signal to a start of application of said third pulse signal, T1 is a pulse width of said first pulse signal, T2 is a time period measured from an end of application of said first pulse signal to a start of application of said second pulse signal, and T3 is a time period measured from an end of application of said second pulse signal to the start of application of said third pulse signal.

23. An inkjet recording apparatus as claimed in claim 22, wherein said first amplitude is greater than or equal to four times said second amplitude.

24. An inkjet recording apparatus as claimed in claim 23, wherein said first pulse signal and said second pulse signal are generated in accordance with an input image signal.

25. An inkjet recording apparatus as claimed in claim 23, wherein said pressure applying device comprises a piezoelectric member.

26. An inkjet recording apparatus as claimed in claim 23, wherein said second pulse signal is smaller than each of said first pulse signal and said third pulse signal in pulse width.

27. An inkjet recording apparatus for forming an ink image on a recording medium, said inkjet recording apparatus comprising:

an ink chamber for accommodating ink therein;

a nozzle connected to said ink chamber;

a pressure applying device for applying pressure to ink in said ink chamber in response to an input pulse voltage; and a driver which is connected to said pressure applying device, wherein said driver is adapted for applying a first pulse signal having a first amplitude, a second pulse signal having a second amplitude, and a third pulse signal to said pressure applying device in sequence as recited, wherein said first amplitude is substantially greater than said second amplitude, wherein each of said first pulse signal and said third pulse signal is adapted for ejecting an ink drop from said nozzle, wherein said second pulse signal is adapted for reducing a reflected wave in said ink chamber induced by said pressure applying device applying said first pulse signal, and wherein timing of application of said first pulse signal, said second pulse signal and said third pulse signal satisfies the following formulas:

$$T0>T3\geqq T2>T1$$

$$T2\geqq 2\times T1$$

$$T3\geqq 3\times T1$$

wherein

T0 is a time period measured from a start of application of said first pulse signal to a start of application of said third pulse signal, T1 is a pulse width of said first pulse signal, T2 is a time period measured from an end of application of said first pulse signal to a start of application of said second pulse signal, and T3 is a time period measured from an end of application of said second pulse signal to the start of application of said third pulse signal.

28. A driving apparatus as claimed in claim 26, wherein said second pulse signal is smaller than each of said first pulse signal and said third pulse signal in amplitude.

29. An inkjet recording apparatus as claimed in claim 28, wherein said first pulse signal and said second pulse signal are generated in accordance with an input image signal.

30. An inkjet recording apparatus as for forming an ink image on a recording medium, said inkjet recording apparatus comprising:

an ink chamber for accommodating ink therein;

a nozzle connected to said ink chamber;

a pressure applying device for applying pressure to ink in said ink chamber in response to an input pulse voltage; and a driver which is connected to said pressure applying device, wherein said driver is adapted for applying a first pulse signal having a first amplitude, a second pulse signal having a second amplitude, and a third pulse signal to said pressure applying device in sequence as recited, wherein said first amplitude is substantially greater than said second amplitude, wherein each of said first pulse signal and said third pulse signal is adapted for ejecting an ink drop from said nozzle, wherein said second pulse signal is adapted for reducing a reflected wave in said ink chamber induced by said pressure applying device applying said first pulse signal, and wherein timing of application of said first pulse signal, said second pulse signal and said third pulse signal satisfies the following formulas:

$$T0>T3\geqq T2>T1$$

$$T2\geqq 2\times T1$$

$$T3\geqq 3\times T1$$

wherein

T0 is a time period measured from a start of application of said first pulse signal to a start of application of said third pulse signal, T1 is a pulse width of said first pulse signal, T2 is a time period measured from an end of application of said first pulse signal to a start of application of said second pulse signal, and T3 is a time period measured from an end of application of said second pulse signal to the start of application of said third pulse signal.

31. An inkjet recording apparatus as a pressure applying device for applying pressure to claimed in claim 28, wherein said second pulse signal is ink in said ink chamber in response to an input pulse smaller than each of said first pulse signal and said voltage; and third pulse signal in pulse width a driver which is connected to said pressure applying device, wherein said driver is adapted for

32. A method for driving an inkjet head, applying comprising the steps of:

a first pulse signal having a first amplitude, (a) ejecting an ink drop from an ink chamber by a second pulse signal having a second amplitude, and applying a first pulse signal having a first amplitude to a third pulse signal a pressure applying device so as to pressurize said ink to said pressure applying device in sequence as recited, chamber;

wherein said first amplitude is substantially (b) reducing a reflected wave in said ink chamber greater than said second amplitude, by applying a second pulse signal having a second wherein each of said first pulse signal and said amplitude to said pressure applying device so as to third pulse signal is adapted for ejecting an ink drop pressurize said ink chamber after step (a), wherein said from said nozzle, reflected wave is induced by the application of said wherein said second pulse signal is adapted for first pulse signal and wherein said first amplitude is reducing a reflected wave in said ink chamber induced by substantially greater than said second amplitude; and said pressure applying device applying said first pulse (c) ejecting an ink drop from said ink chamber by signal, and applying a third pulse signal to said pressure applying wherein timing of application of said first pulsedevice so as to pressurize said ink chamber after step signal, said second pulse signal and said third pulse (b), wherein timing of application of said first pulse signal, said second pulse signal, and said third pulse signal satisfies the following formulas:

$$T0>T3\geqq T2>T1$$

$$T2\geqq 2\times T1$$

$$T3\geqq 3\times T1$$

wherein

T0 is a time period measured from a start of application of said first pulse signal to a start of application of said third pulse signal, T1 is a pulse width of said first pulse signal, T2 is a time period measured from an end of application of said first pulse signal to a start of application of said second pulse signal, and T3 is a time period measured from an end of application of said second pulse signal to the start of application of said third pulse signal.

33. An inkjet recording apparatus as claimed in claim 31, wherein said second pulse signal is is smaller than each of said first pulse signal and said third pulse signal in amplitude.

34. A method as claimed in claim 33, wherein said first pulse signal and said second pulse signal are generated in accordance with an input image signal.

35. A method as claimed in claim 33, wherein said pressure applying device comprises a piezoelectric member.

36. A method for driving an inkjet head, comprising the steps of:

(a) ejecting an ink drop from an ink chamber by applying a first pulse signal to a pressure applying device so as to pressurize said ink chamber;

(b) reducing a reflected wave in said ink chamber by applying a second pulse signal to said pressure applying device so as to pressurize said ink chamber after step (a), wherein said reflected wave is induced by the application of said first pulse signal; and (c) ejecting an ink drop from said ink chamber by applying a third pulse signal to said pressure applying device so as to pressurize said ink chamber after step wherein timing of application of said first pulse signal, said second pulse signal and said third pulse signal satisfies the following formulas:

$$T0>T3\geqq T2>T1,$$

$$T2\geqq 2\times T1, \text{ and}$$

$$T3\geqq 3\times T1$$

wherein

T0 is a time period measured from a start of application of said first pulse signal to a start of application of said third pulse signal, T1 is a pulse width of said first pulse signal, T2 is a time period measured from an end of application of said first pulse signal to a start of application of said second pulse signal, and T3 is a time period measured from an end of application of said second pulse signal to the start of application of said third pulse signal.

37. An inkjet recording apparatus comprising:

an ink chamber;

a driving apparatus; and a pressure applying device adapted for applying pressure to ink, accommodated in said ink chamber, in accordance with a pulse signal applied by said driving apparatus, said driving apparatus adapted for applying a first pulse signal having a first amplitude, a second pulse signal having a second amplitude, and a third pulse signal to said pressure applying means in sequence as recited, wherein said first amplitude is substantially greater than said second amplitude, wherein each of said first pulse signal and said third pulse signal is adapted for ejecting an ink drop from said ink chamber, wherein said second pulse signal is adapted for avoiding ejecting an ink drop from said nozzle, wherein timing of application of said first pulse signal, said second pulse signal and said third pulse signal satisfies the following formulas:

$$T0>T3\geqq T2>T1$$

$$T2\geqq 2\times T1$$

$$T3\geqq 3\times T1$$

wherein

T0 is a time period measured from a start of application of said first pulse signal to a start of application of said third pulse signal, T1 is a pulse width of said first pulse signal, T2 is a time period measured from an end of application of said first pulse signal to a start of application of said second pulse signal, and T3 is a time period measured from an end of application of said second pulse signal to the start of application of said third pulse signal.

38. An inkjet recording apparatus as claimed in claim 37, wherein said first amplitude is greater than or equal to four times said second amplitude.

39. An inkjet recording apparatus as claimed in claim 38, wherein said first pulse signal and said second pulse signal are generated in accordance with an input image signal.

40. An inkjet recording apparatus as claimed in claim 38, wherein said pressure applying device comprises a piezoelectric member.

41. An inkjet recording apparatus as claimed in claim 38, wherein said second pulse signal is smaller than each of said first pulse signal and said third pulse signal in pulse width.

* * * * *

UNITED STATES PATENT AND TRADEMARK OFFICE

CERTIFICATE OF CORRECTION

PATENT NO. : 6,089,690
DATED : July 18, 2000
INVENTOR(S) : Hideo Hotomi

It is certified that error appears in the above-identified patent and that said Letters Patent is hereby corrected as shown below:

Title page,
Item [75] Inventor:, after "Hotomi", delete "Nishinomiya,", and insert -- Nishinomiya Shi, --.

Column 4,
Line 23, delete "roller, which is not shown in Fig. 1", and insert -- roller (which is not shown in Fig. 1) --.

Column 14,
Delete claim 28 in its entirety, and insert the following therefor:

-- 28. An inkjet recording apparatus as claimed in claim 27, wherein said first amplitude is greater than or equal to four times said second amplitude. --.

Column 14,
Delete claim 30 in its entirety, and insert the following therefor:

-- 30. An inkjet recording apparatus as claimed in claim 28, wherein said pressure applying device comprises a piezoelectric member. --.

Column 15,
Delete claim 31 in its entirety, and insert the following therefor:

-- 31. An inkjet recording apparatus as claimed in claim 28, wherein said second pulse signal is smaller than each of said first pulse signal and said third pulse signal in pulse width. --.

UNITED STATES PATENT AND TRADEMARK OFFICE

CERTIFICATE OF CORRECTION

PATENT NO. : 6,089,690
DATED : July 18, 2000
INVENTOR(S) : Hideo Hotomi

It is certified that error appears in the above-identified patent and that said Letters Patent is hereby corrected as shown below:

Column 15,
Delete lines 13-24 (claim 32, lines 1-10), and
insert the following therefor:

-- 32. A method for driving an inkjet head, comprising the steps of:

(a) ejecting an ink drop form an ink chamber by applying a first pulse signal having a first amplitude to a pressure applying device so as to pressurize said ink chamber; -.

Column 15,
Delete lines 25-47 (claim 32, lines 11-33), and insert the following therefor:

-- (b) reducing a reflected wave in said ink chamber by applying a second pulse signal having a second amplitude to said pressure applying device so as to pressurize said ink chamber after step (a), wherein said reflected wave is induced by the application of said first pulse signal and wherein said first amplitude is substantially greater than said second amplitude; and (c) ejecting an ink drop from said ink chamber by applying a third pulse signal to said pressure applying device so as to pressurize said ink chamber after step (b), wherein timing of application of said first pulse signal, said second pulse signal, and said third pulse signal satisfies the following formulas: --.

Columm 15,
Delete lines 50-67 (lines 34-47 of claim 32),
and insert the following therefor:

-- $T0>T3\geq T2>T1$
$T2\geq 2xT1$
$T3\geq 3xT1$ wherein

UNITED STATES PATENT AND TRADEMARK OFFICE

CERTIFICATE OF CORRECTION

PATENT NO. : 6,089,690
DATED : July 18, 2000
INVENTOR(S) : Hideo Hotomi

It is certified that error appears in the above-identified patent and that said Letters Patent is hereby corrected as shown below:

T0 is a time period measured from a start of application of said first pulse signal to a start of application of said third pulse signal, T1 is a pulse width of said first pulse signal, T2 is a time period measured from an end of application of said first pulse signal to a start of application of said second pulse signal, and T3 is a time period measured form an end of application of said second pulse signal to the start of application of said third pulse signal. --.

Column 16,
Delete claim 33 in its entirety, and insert the following therefor:

-- 33. A method as claimed in claim 32, wherein said first amplitude is greater than or equal to four times said second amplitude. --.

UNITED STATES PATENT AND TRADEMARK OFFICE

CERTIFICATE OF CORRECTION

PATENT NO. : 6,089,690
DATED : July 18, 2000
INVENTOR(S) : Hideo Hotomi

It is certified that error appears in the above-identified patent and that said Letters Patent is hereby corrected as shown below:

Column 16,
Delete claim 36 in its entirety, and insert the following therefor:

-- 36. A method as claimed in claim 33, wherein said second pulse signal is smaller than each of said first pulse signal and third pulse signal in pulse width. --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*

UNITED STATES PATENT AND TRADEMARK OFFICE

CERTIFICATE OF CORRECTION

PATENT NO. : 6,089,690
DATED : July 18, 2000
INVENTOR(S) : Hideo Hotomi

It is certified that error appears in the above-identified patent and that said Letters Patent is hereby corrected as shown below:

Title page,
Item [75] Inventor:, after "Hotomi", delete "Nishinomiya,", and insert -- Nishinomiya Shi, --.

Column 4,
Line 23, delete "roller, which is not shown in Fig. 1", and insert -- roller (which is not shown in Fig. 1) --.

Column 14,
Delete claim 28 in its entirety, and insert the following therefor:
-- 28. An inkjet recording apparatus as claimed in claim 27, wherein said first amplitude is greater than or equal to four times said second amplitude. --.

Column 14,
Delete claim 30 in its entirety, and insert the following therefor:
-- 30. An inkjet recording apparatus as claimed in claim 28, wherein said pressure applying device comprises a piezoelectric member. --.

Column 15,
Delete claim 31 in its entirety, and insert the following therefor:
-- 31. An inkjet recording apparatus as claimed in claim 28, wherein said second pulse signal is smaller than each of said first pulse signal and said third pulse signal in pulse width. --.
Delete lines 13-24 (claim 32, lines 1-10), and insert the following therefor:
-- 32. A method for driving an inkjet head, comprising the steps of:
(a) ejecting an ink drop from an ink chamber by applying a first pulse signal having a first amplitude to a pressure applying device so as to pressurize said ink chamber; --.

UNITED STATES PATENT AND TRADEMARK OFFICE

CERTIFICATE OF CORRECTION

PATENT NO. : 6,089,690
DATED : July 18, 2000
INVENTOR(S) : Hideo Hotomi

It is certified that error appears in the above-identified patent and that said Letters Patent is hereby corrected as shown below:

Column 15, (cont'd)
Delete lines 25-47 (claim 32, lines 11-33), and insert the following therefor:
-- (b) reducing a reflected wave in said ink chamber by applying a second pulse signal having a second amplitude to said pressure applying device so as to pressurize said ink chamber after step (a), wherein said reflected wave is induced by the application of said first pulse signal and wherein said first amplitude is substantially greater than said second amplitude; and (c) ejecting an ink drop from said ink chamber by applying a third pulse signal to said pressure applying device so as to pressurize said ink chamber after step (b), wherein timing of application of said first pulse signal, said second pulse signal, and said third pulse signal satisfies the following formulas: --.
Delete lines 50-67 (lines 34-47 of claim 32), and insert the following therefor:

-- $T0>T3\geq T2>T1$
$T2\geq 2xT1$
$T3\geq 3xT1$ wherein
T0 is a time period measured from a start of application of said first pulse signal to a start of application of said third pulse signal,
T1 is a pulse width of said first pulse signal, T2 is a time period measured from an end of application of said first pulse signal to a start of application of said second pulse signal, and T3 is a time period measured from an end of application of said second pulse signal to the start of application of said third pulse signal. --.

UNITED STATES PATENT AND TRADEMARK OFFICE

CERTIFICATE OF CORRECTION

PATENT NO. : 6,089,690
DATED : July 18, 2000
INVENTOR(S) : Hideo Hotomi

It is certified that error appears in the above-identified patent and that said Letters Patent is hereby corrected as shown below:

Column 16,

Delete claim 33 in its entirety, and insert the following therefor:

-- 33. A method as claimed in claim 32, wherein said first amplitude is greater than or equal to four times said second amplitude. --.

Delete claim 36 in its entirety, and insert the following therefor:

-- 36. A method as claimed in claim 33, wherein said second pulse signal is smaller than each of said first pulse signal and said third pulse signal in pulse width. --.

This certificate supersedes Certificate of Correction issued November 13, 2001.

Signed and Sealed this

Twenty-sixth Day of March, 2002

*Attest:*

*Attesting Officer*

JAMES E. ROGAN
*Director of the United States Patent and Trademark Office*